US006530817B1

(12) United States Patent
Winslow et al.

(10) Patent No.: US 6,530,817 B1
(45) Date of Patent: Mar. 11, 2003

(54) TOY TOP SYSTEM AND RELATED METHODS

(75) Inventors: Scott Edward Winslow, Shadow Hills, CA (US); Spencer L. Mackay, Agoura Hills, CA (US)

(73) Assignee: Ideavillage, LLC, Fairfield, NJ (US)

( * ) Notice: Subject to any disclaimer, the term of this patent is extended or adjusted under 35 U.S.C. 154(b) by 93 days.

(21) Appl. No.: 09/641,713

(22) Filed: Aug. 21, 2000

(51) Int. Cl.[7] ..... A63H 1/00

(52) U.S. Cl. ..... 446/256; 4446/259; 4446/263; 4446/264; 4446/40

(58) Field of Search ..... 446/236, 256, 446/257, 258, 259, 260, 261, 262, 263, 264, 34, 36, 37, 38, 39, 40, 42, 43, 41, 45; 273/147, 440; 473/588, 614, 595, 575

(56) References Cited

U.S. PATENT DOCUMENTS

| | | | | | |
|---|---|---|---|---|---|
| 547,764 | A | * | 10/1895 | Boyum | 273/147 |
| 791,080 | A | * | 5/1905 | Davenport | 446/256 |
| 896,628 | A | * | 8/1908 | Davenport | 446/256 |
| D54,457 | S | * | 2/1920 | Sandstrom | 446/256 |
| 1,462,091 | A | * | 7/1923 | Lindstrom | 446/260 |
| 1,537,312 | A | * | 5/1925 | Korona | 446/256 |
| 1,570,206 | A | * | 1/1926 | Connell | 446/260 |
| 1,680,423 | A | * | 8/1928 | Lindstrom | 446/260 |
| 1,783,627 | A | * | 12/1930 | Raimondi | 446/256 |
| 1,907,419 | A | * | 5/1933 | Wetzell | 446/257 |
| 2,394,093 | A | * | 2/1946 | Nalle, Jr. | 446/256 |
| D156,773 | S | * | 1/1950 | Schaper | 446/236 |
| 2,564,053 | A | * | 8/1951 | Donovan | 446/40 |
| 2,633,664 | A | * | 4/1953 | Nielson | 446/257 |
| 2,671,663 | A | * | 3/1954 | Gurt et al. | 446/256 |
| 2,879,066 | A | * | 3/1959 | Sutherland | 273/147 |
| 2,906,057 | A | * | 9/1959 | Sullivan | 446/256 |
| 3,188,768 | A | * | 6/1965 | Boswell | 446/45 |
| 3,316,672 | A | * | 5/1967 | Dixon | 446/258 |
| 3,323,491 | A | * | 6/1967 | Granick | 446/256 |
| 3,876,205 | A | * | 4/1975 | Drohomirecky | 446/256 |
| 4,211,030 | A | * | 7/1980 | Morrison et al. | 446/188 |
| 4,295,290 | A | * | 10/1981 | Boswell | 446/45 |
| 4,304,064 | A | | 12/1981 | Kulesza | |
| 4,538,999 | A | * | 9/1985 | Orlowski | 446/259 |
| 4,932,918 | A | * | 6/1990 | Onoda | 446/256 |
| 5,020,798 | A | * | 6/1991 | Yang | 446/257 |
| 5,026,057 | A | | 6/1991 | Watford | |
| 5,122,809 | A | | 6/1992 | Horan | |
| 5,525,086 | A | * | 6/1996 | Gentile et al. | 446/37 |
| 5,683,284 | A | | 11/1997 | Christen | |
| 5,827,107 | A | * | 10/1998 | Bears et al. | 446/259 |

* cited by examiner

*Primary Examiner*—Derris H. Banks
*Assistant Examiner*—Urszula M Cegielnik
(74) *Attorney, Agent, or Firm*—Bazerman & Drangel, PC

(57) ABSTRACT

A toy top comprises a body having an external surface with at least one external cavity and at least one extendable protrusion; in a static position, the protrusion is situated within the cavity and in a spinning motion, the protrusion is in an extended position from the cavity.

3 Claims, 5 Drawing Sheets

TOY TOP SYSTEM AND RELATED METHODS

FIELD OF THE INVENTION

The present invention relates to toy tops having protrusions which allow the tops to "battle". More specifically, the present invention relates to toy top system comprising at least two tops which are launched toward one another and have extendable protrusions that contact one another when the tops are spinning.

BACKGROUND OF THE INVENTION

Spinning tops have been a popular toy for children over the years. These toy tops have surpassed the test of time and survived the modernization, computerization and fluctuality trends of the toy industry. Children have also popularized battling games. Whether motivated by strategy, sheer competition or raw excitement, children are drawn to various types of battling games. The present invention provides a toy top system that combines the popularity of spinning tops with battling games.

SUMMARY OF THE INVENTION

The present invention relates to a toy top that comprises a body having rotational symmetry about a longitudinal axes. The body has a tapered lower portion leading to a tip situated on the longitudinal axis. In one embodiment, the tip is designed to support the body of the top when the top is in a spinning motion or movement. In another embodiment, the body has an external surface with at least one external cavity and at least one extendable protrusion. In still another embodiment, this protrusion is situated within the cavity during a static position of the top. In yet another embodiment, the protrusion is in an extended position from the cavity during a spinning motion or movement of the top. In another embodiment, the protrusion is retractable from the cavity.

In a further embodiment, the body of the top comprises a top portion having a central bore designed for receiving a top launcher. In yet a further embodiment, the central bore of the top portion of the body of the top is defined by a cylindrical wall.

In another embodiment, the toy top further comprises a launcher for creating the rotational energy for spinning the top. In still another embodiment, the launcher is a spring loaded manually operated launcher. In yet another embodiment, the launcher is a motorized launcher. The present invention can work with any launcher or launcher system.

In still yet another embodiment, the body has an internal hollow portion. In a further embodiment, the body comprises a solid plastic polymer. In still a further embodiment, the protrusion comprises a soft, flexible foam. In yet a further embodiment, the protrusion is a simulated weapon. In another embodiment, the protrusion may be shaped into simulated forms including, but not limited to, swords, sabers, axes, lances, maces, stars, blades, guns, etc.

In a further embodiment, the toy top of the present invention comprises top and bottom portions. In still a further embodiment, the tops includes a middle portion designed to fit in between the top and bottom portions. In yet a further embodiment, the middle portion of the top has at least one extended portion that is longer than the circumference of the top and bottom portions of the top, such that when the top and bottom portions are mated, the extended portions protrudes from the outer surface of the top. In still yet a further embodiment, the top and bottom portions are constructed of a hard plastic and the middle portion is constructed of a soft foam material. In still another further embodiment, the tops furthered include a securing device for attaching the top portion to the bottom portion of the top to thereby sandwich the middle portion in between the top and bottom portions. In another embodiment, the securing devices are screws.

In another embodiment, the present invention relates to a toy top system comprising at least two battling tops and a means for launching the tops. In still another embodiment, each of the two tops comprises a body having rotational symmetry about a longitudinal axis, each of the bodies has a tapered lower portion leading to a tip being situated on the longitudinal axis and being designed to support the body during a spinning movement of the tops. In yet another embodiment, each of the tops has an external surface; at least one of the tops has an external surface with at least one external cavity and at least one extendable protrusion. In still yet another embodiment, the protrusion is situated within the cavity during a static position of the top and the protrusion is in an extended position during a spinning movement of the top. In another embodiment, the protrusion is retractable from the cavity. In a further embodiment, the second top has a protrusion situated on the external surface. In still a further embodiment, each of the tops are set in a spinning motion toward one another to allow the protrusion to contact one another. In yet a further embodiment, the system comprises a means for launching the top into a spinning motion.

In another embodiment, the second top also comprises an external cavity situated on the external surface and the protrusion is a retractable or extendable protrusion. When the top is in a static or motionless position, the protrusion is set into the external cavity. When the top is set in a spinning motion, the centrifugal energy forces the protrusion out of the cavity and allows the protrusion to be extended from the cavity.

In yet another embodiment, the means for launching the tops comprises a toy launcher. In a further embodiment, the launcher is a spring loaded manually operated launcher. In still a further embodiment, the launcher is a battery operated, motorized launcher. In yet a further embodiment, each of the bodies of the top comprises a top portion having a central bore designed for receiving the launching means. In another embodiment, the central bore is defined by a cylindrical wall.

In still another embodiment, each of the bodies of the tops has an internal hollow portion. In yet another embodiment, the bodies of the tops comprises a solid plastic polymer. In still yet another embodiment, the protrusion comprises a soft, flexible foam or pliable polymer material. In a further embodiment, the system comprises a simulated battle arena for allowing the tops to engage one another and allow the protrusion of the tops to contact one another and thus, "battle". The arena can be any form or shape. In one embodiment, the arena has floors which are slanted toward the center of the arena. In another embodiment, the arena is a square or rectangular arena with floors comprising two opposing ends which are angled toward the center of the arena. In still another embodiment, the arena is a circle that forms a concave floor for directing the tops toward the center of the arena. In yet another embodiment, the arena comprises external walls for surrounding the arena floor.

In a further embodiment, the two tops are launched toward one another and the protrusions contact one another;

the winner is determined to be the top that remains spinning after the contact. In still another embodiment, the tops are launched within the arena and the top that remains within the arena is determined to be the winner.

In another embodiment, the present invention relates to a method of allowing toy tops to battle one another; the method comprises: providing at least two toy tops, each of the tops comprises a body having rotational symmetry about a longitudinal axis, each of the bodies has a tapered lower portion leading to a tip being situated on the longitudinal axis and being designed to support the body during the spinning movement of each of the tops; each of the tops having an external surface with at least one of the tops having an external surface with at least one external cavity and at least one extendable protrusion, the protrusion; being situated within the cavity during a static position of the and the protrusion being in an extended position from the cavity during a spinning movement of the top; the second top having a protrusion situated on the external surface; and setting each of the tops in a spinning motion toward one another and allowing the protrusion to contract one another.

In still another embodiment, the tops are set in a spinning motion by at least one top launcher. In yet another embodiment, the second top comprises an external cavity situated on its external surface, the protrusion being a retractable or extendable protrusion; the protrusion being situated within the external cavity during a static position of the top and being in an extended position from the cavity during the spinning movement of the top.

In still yet another embodiment, each of the bodies of the tops comprise a top portion having a central bore designed for receiving the launcher. In a further embodiment, the central bore of each of the bodies of the top are defined by a cylindrical wall. In still a further embodiment, the method further comprises providing an arena for allowing the tops to engage one another. In yet a further embodiment, the method further comprises setting the tops in a spinning motion within the arena.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principle of the present invention.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessary to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Figure 1:
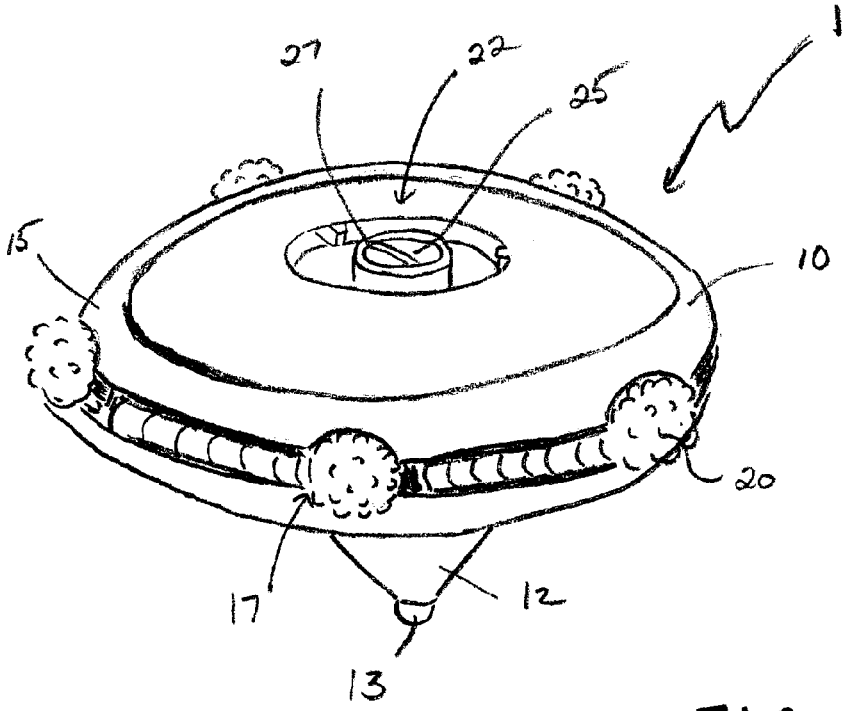
FIG. 1 is a perspective view of the toy top of the present invention in a static position.

FIG. 1 depicts a perspective view of the toy top 1 of the present invention in a static position. The top 1 has a body 10 with rotational symmetry around a longitudinal axis; the body 10 has a tapered lower portion 12 leading to a tip 13 situated on the longitudinal axis. The tip 13 is designed to support the body 10 during a spinning motion of the top 1. The body 10 has an external surface 15 with at least one external cavity 17 and at least one extendable protrusion 20. In the static position, the protrusion 20 is situated with the cavity 17. The body 10 also comprises a top portion 22 having a central bore 25 designed for receiving a top launcher. In one embodiment, the central bore 25 is defined by a cylindrical wall 27.

In one embodiment, the body 10 has an internal hollow portion. In another embodiment, the body 10 comprises a solid plastic polymer are the protrusion 20 comprises a soft, flexible foam. In still another embodiment, the protrusion is a simulated weapon.

Figure 2:
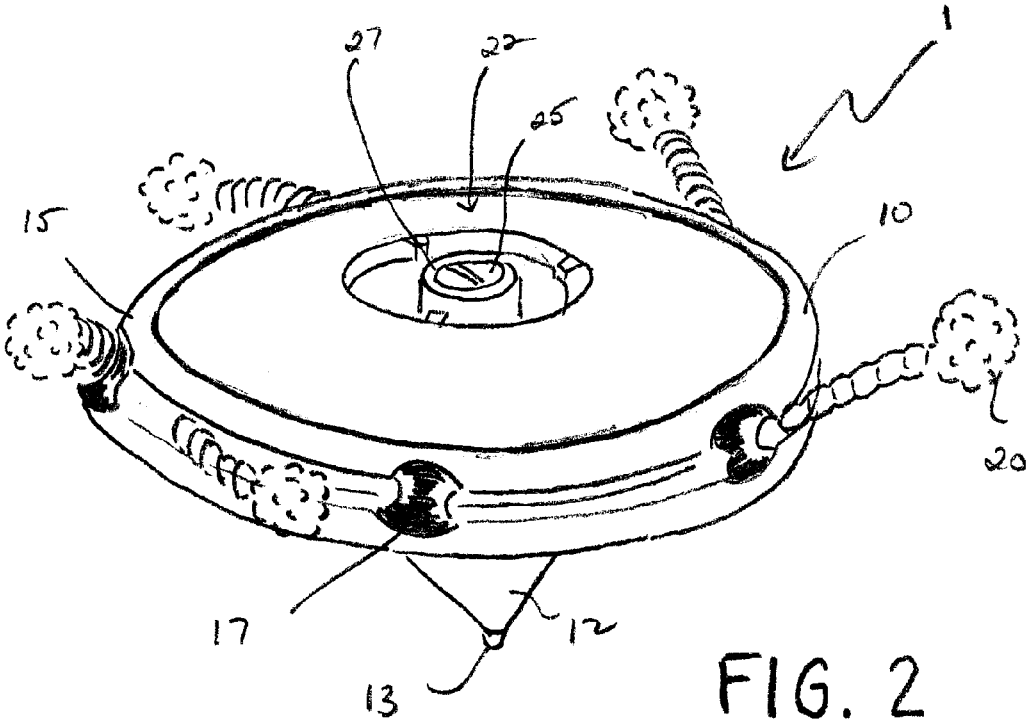
FIG. 2 is a perspective view of the toy top of the present invention in a spinning motion.

FIG. 2 depicts the perspective view of the toy top 1 of the present invention in a spinning motion. The launcher creates rotational or centrifugal energy from spinning the top 1. The rotational or centrifugal energy forces the protrusion 20 to extend from the external cavity 17, during the top's 1 spinning motion of the top 1. The protrusion 20 is a simulated weapon, in this case, a mace.

Figure 3:
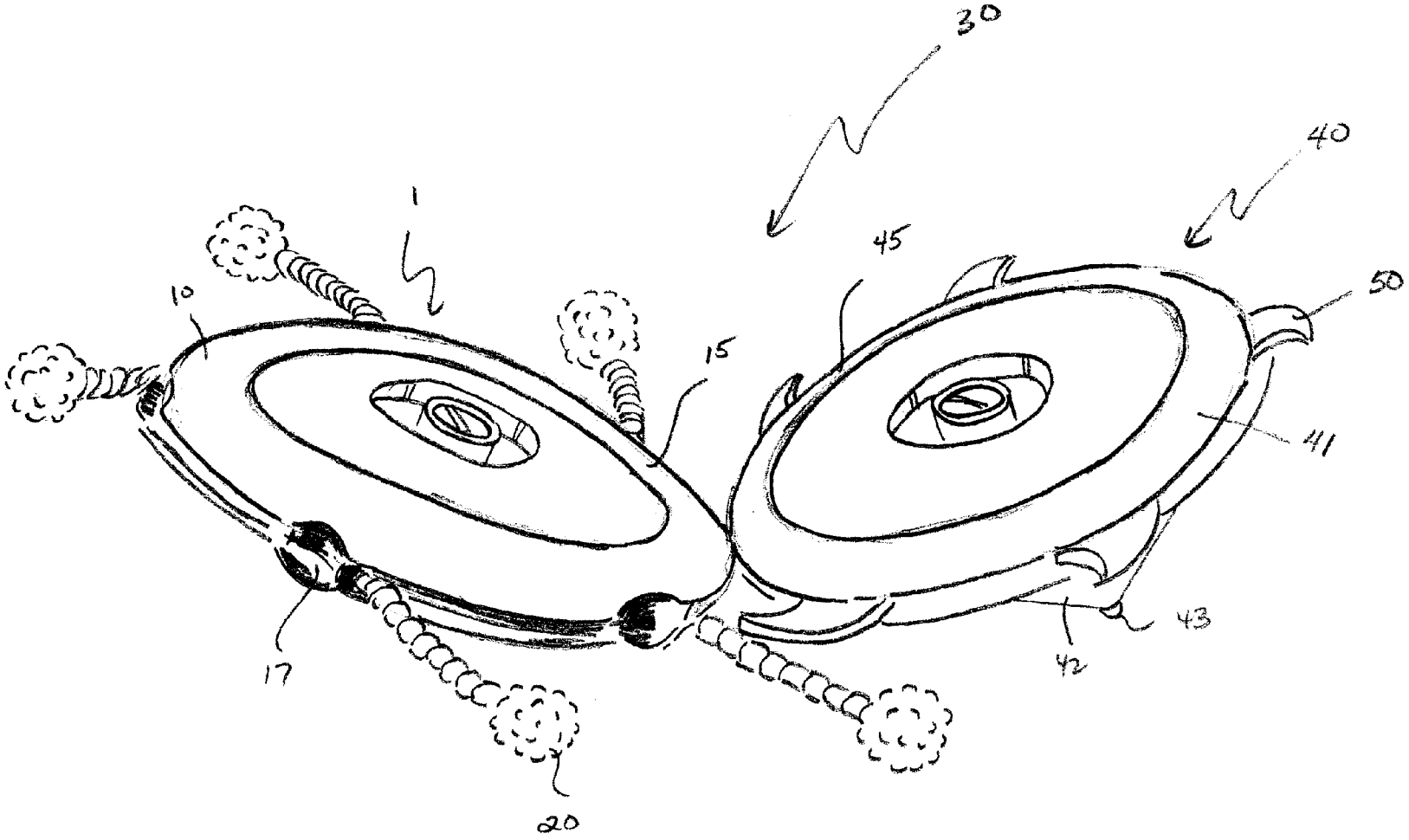
FIG. 3 is a perspective view of the toy top system of the present invention including the toy tops and the launch.

FIG. 3 illustrates a prospective view of the system 30 of the present invention. The system 30 comprises two toy tops, 1 and 40, respectively. Each of the tops, 1 and 40, comprises a body 10 and 41 respectively, having rotational symmetry around a longitudinal axis. Each of the bodies has a tapered lower portion, 12 and 42 respectively, leading to a tip 13 and 43 respectively. Each of the tops 1 and 40 have external surfaces, 15 and 45 respectively.

The first top 1 has a body 10 with a plurality of external cavities 17 and a plurality of extendable protrusion 20. During the spinning motion of the top, the protrusion 20 is in an extended position from the external cavity 17.

The second toy 40 has a protrusion 50 situated on its external surface 45. The tops 1 and 40 are set in a spinning motion toward one another to allow the protrusions 20 and 50 to contact one another.

Figure 4:
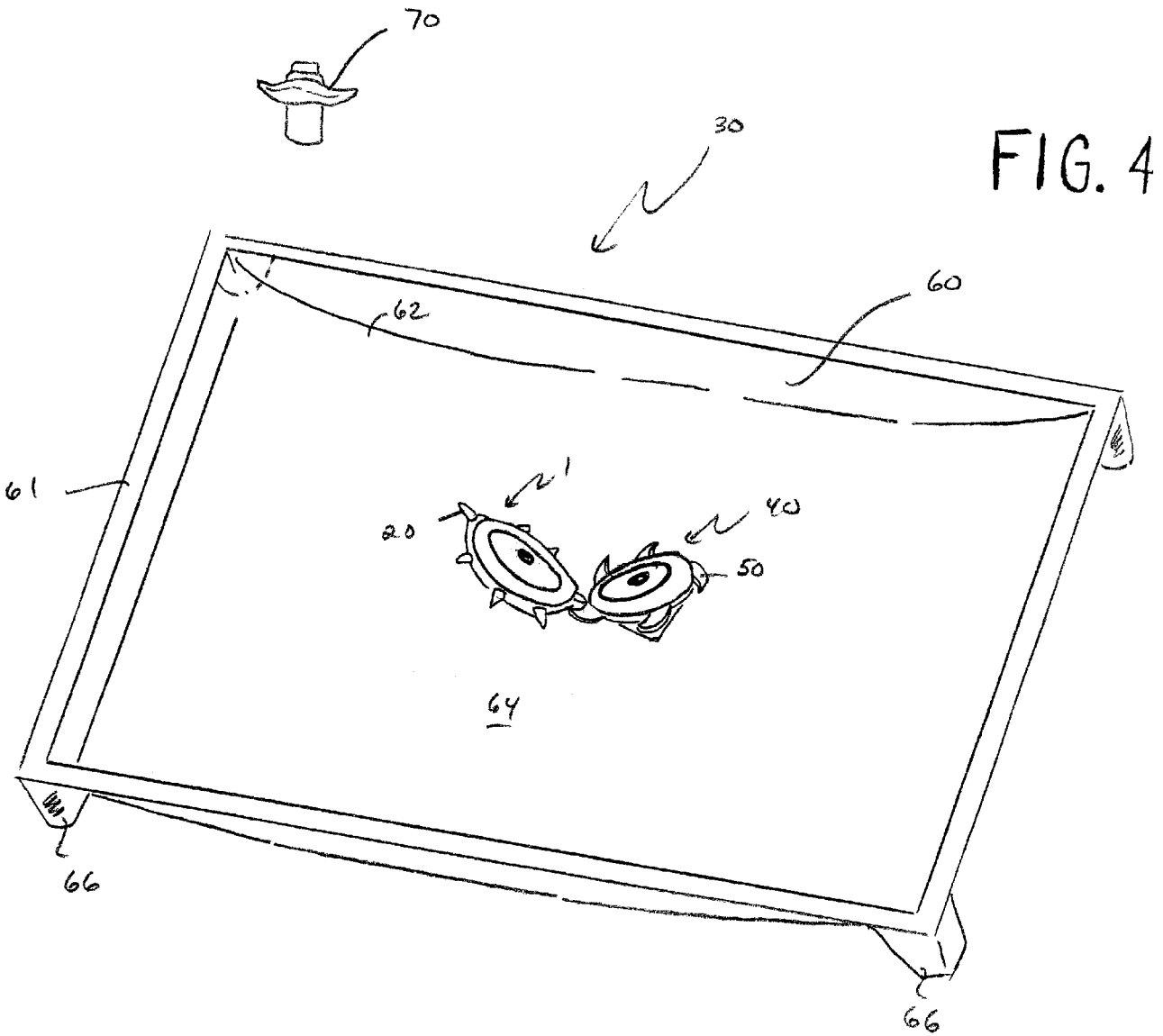
FIG. 4 is a perspective view of the toy top system and the battle arena.

FIG. 4 depicts a perspective view of the toy top system 30 of the present invention with an arena 60. The system 30 comprises at least two tops, 1 and 40 respectively, and at least two launchers 70. The launchers 70 create rotational energy for spinning the tops, 1 and 40. The launchers 70 may be a spring loaded manually operated launcher or a motorized launcher. The launcher 70 set the tops, 1 and 40, in a spinning motion toward one another and the protrusion 20 and 50 contact one another. Each top has a central bore for receiving the launcher 70. The arena 60 comprises borders 61 and a floor 62. The floor 62 is angled towards the center of the arena 64 so that the tops 1 and 40, gravitate toward the center 64 and engage one another. In one embodiment, the arena 60 has legs 66.

Figure 5:
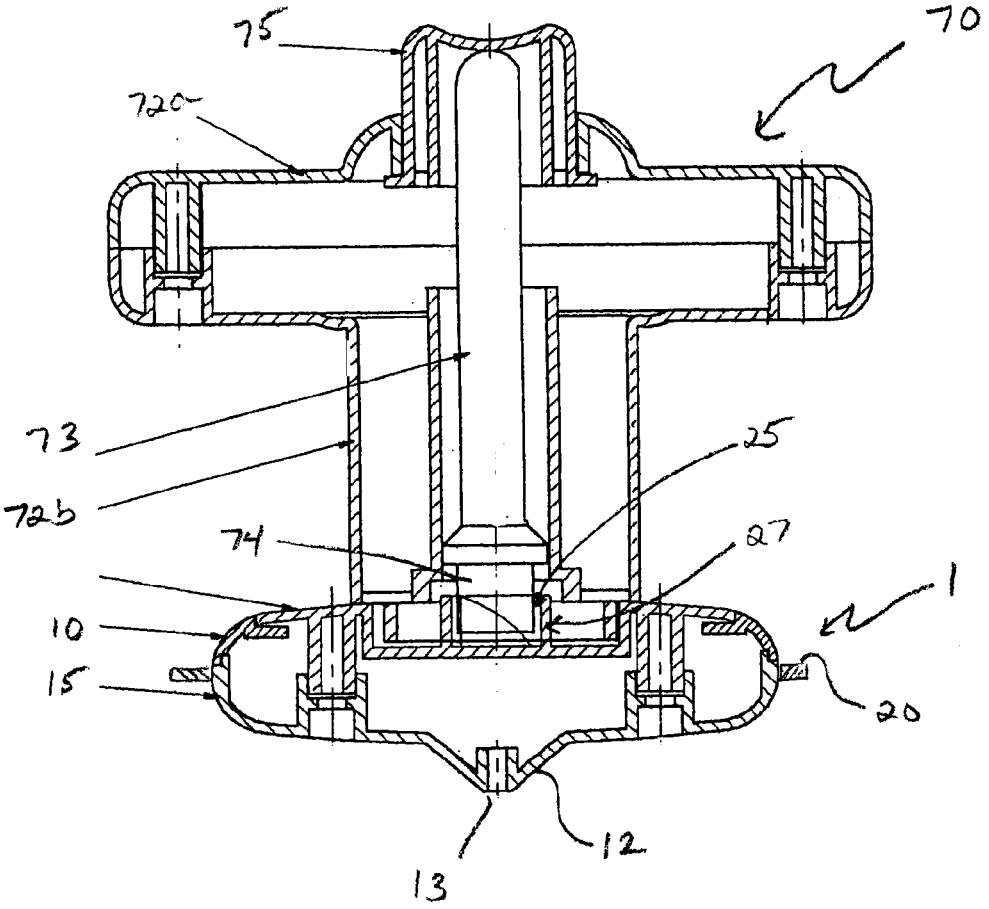
FIG. 5 is a cross-sectional view of the launcher and top of the present invention.

FIG. 5 shows a cross-sectional view of the launcher 70 and toy top 1 in a mating position. The top 1 has a body 10 with a tapered lower portion 12 leading to a tip 13. The top 1 also has a external surface 15, a protrusion 20 and a central bore 25 for receiving the launcher 70. The central bore 25 is defined by a cylindrical wall 27. The top 1 also has a protrusion 20.

The launcher 70 has an upper housing 72*a* and a lower housing 72*b*. The launcher also has a central rotatable rod 73. The rod 73 has a bottom portion 74 designed to fit within the central bore 25 of the top 1. The launcher 70 also has an activation button 75 for releasing the top 1.

Figure 6:
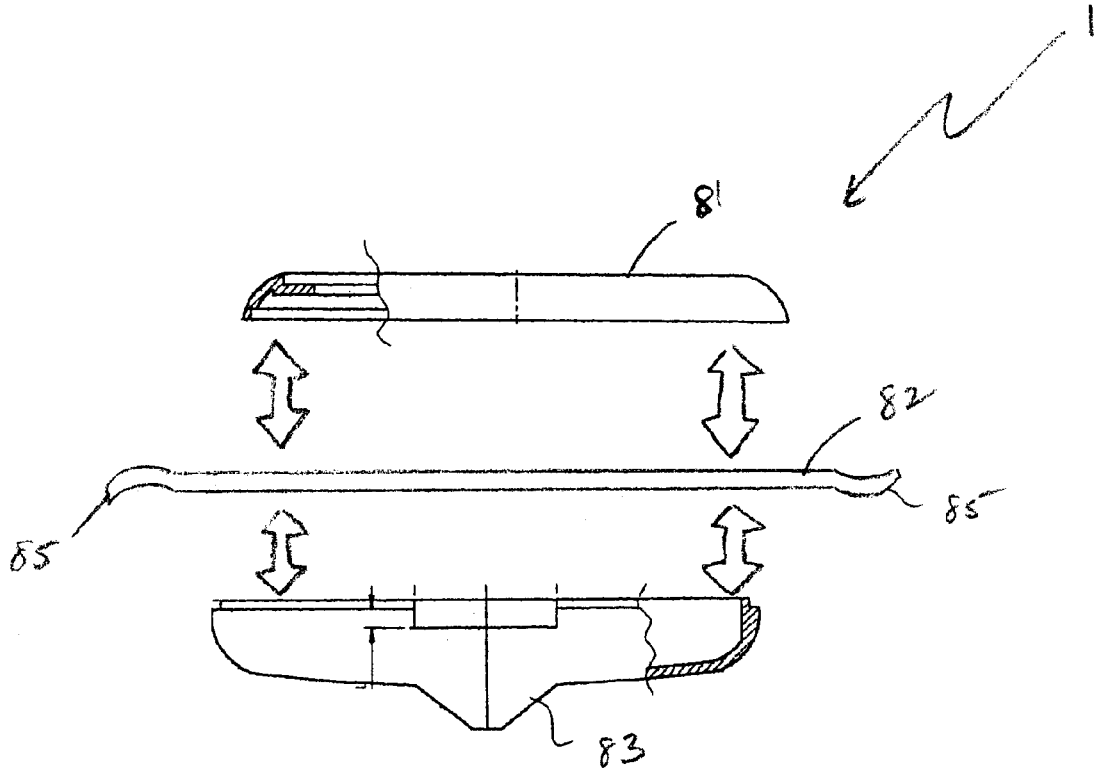
FIG. 6 is a partial cross-sectional view of one of the embodiments of the top, middle and bottom portions of the top.

FIG. 6 is a partial cross-sectional side of one of the embodiments of the top 1 of the present invention. The top 1 comprises a top portion 81, middle portion 82, and bottom portion 83. The top portion 81 is designed to mate with the bottom portion 83 and sandwich the middle portion 82. The middle portion 82 has at least one extended portion 85, which protrudes externally from the surface of the top 1 when the top and bottom portions, 81 and 83 respectively, of the top 1 are mated. The top and bottom portions, 81 and 83 respectively, are constructed of a hard plastic and the middle portion 82 is constructed of a soft foam material.

Numerous modifications and variations of the present invention are possible in light of the above tracings. It is therefore to be understood that within the scopes of the attendant claims attached hereto, this invention may be practiced otherwise than as specifically disclosed herein.

What is claimed is:

1. A toy top system comprising:

at least two toy tops, each of said tops comprising a body having rotational symmetry about a longitudinal axis, each of said bodies having a tapered lower portion leading to a tip being situated of said longitudinal axis and being designed to support said body during a spinning movement of each of said tops;

each of said tops having an external surface; at least one of said tops having an external surface with at least one external cavity and at least one extendable protrusion, said protrusion being situated with said cavity during a static position of said top and said protrusion being in an extended position from said cavity during a spinning movement of said top;

a second top having a protrusion situated on an external surface;

each of said tops being set in a spinning movement toward one another to allow said protrusion of each of said tops to contact one another; and a means for launching said tops into a spinning movement;

wherein said second top comprises top, middle and bottom portions;

said top portion being designed to mate with said bottom portion and sandwich said middle portion;

said middle portion having at least one extended portion whereby, said extended portion protrudes from an external side surface of said tops.

2. The toy top system of claim 1 wherein said top and bottom portions of said tops comprises a hard plastic polymer and said middle portion comprises a soft, flexible foam material.

3. The toy top system of claim 1 wherein said tops further comprises a securing device for attaching said top portion to said bottom portion.

* * * * *